United States Patent [19]

Allen

[11] 4,084,084

[45] Apr. 11, 1978

[54] BUBBLER AND AUTOMATIC LIGHT

[76] Inventor: Buford W. Allen, Rte. 1, Box 22, Moore, Tex. 78057

[21] Appl. No.: 729,698

[22] Filed: Oct. 5, 1976

[51] Int. Cl.[2] ..... F21V 33/00

[52] U.S. Cl. ..... 362/184; 200/83 T; 200/83 Y; 362/237

[58] Field of Search ..... 200/81.4, 81.5, 83 Q, 200/83 T, 83 Y; 240/1 R, 2 R, 2 S, 2 V, 6.4 R, 6.4 G, 10 R

[56] References Cited

U.S. PATENT DOCUMENTS

| | | | |
|---|---|---|---|
| 2,070,818 | 2/1937 | Winckler | 240/6.4 R |
| 2,617,501 | 11/1952 | Quelle | 240/10 R UX |
| 3,535,282 | 10/1970 | Mallory | 200/83 T X |
| 3,968,359 | 7/1976 | Shaffer | 240/10 R X |

*Primary Examiner*—Fred L. Braun

[57] ABSTRACT

An illuminating device having an L-shaped housing with a light source at each end, a diaphragm actuated switch for each light source, an air line in fluid communication with each leg of the housing, and a tube interconnecting the housing legs for permitting water to flow between the respective legs. The actuation of the switch is determined by the orientation of the housing and the flow of water between the respective legs.

4 Claims, 3 Drawing Figures

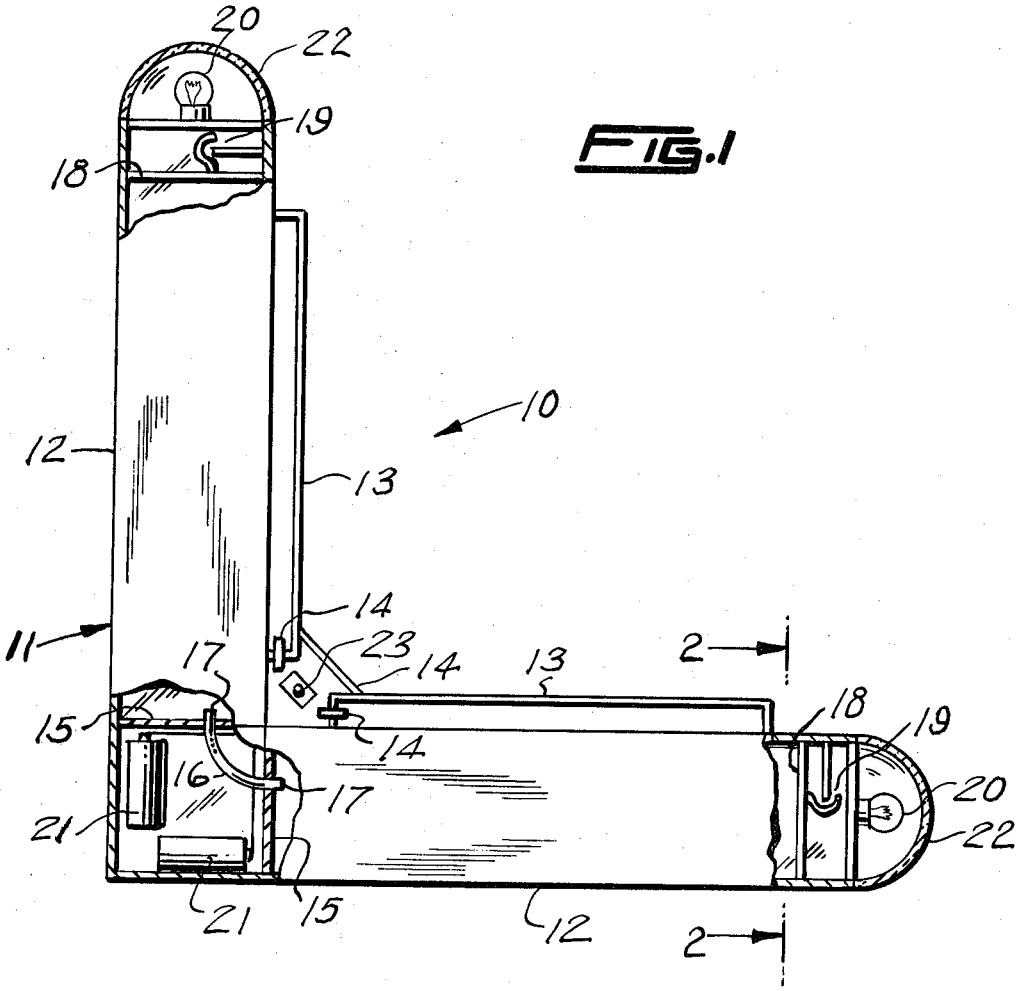
FIG. 1
FIG. 2
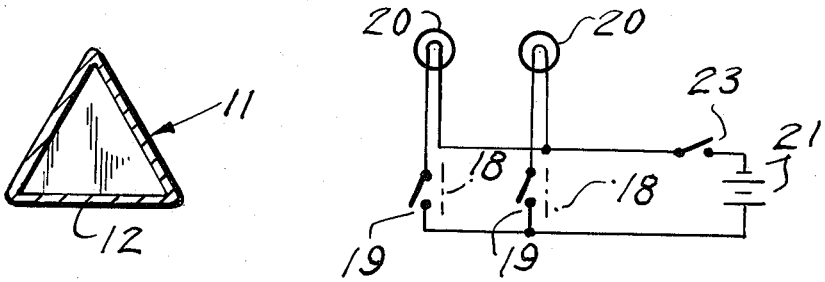
FIG. 3

BUBBLER AND AUTOMATIC LIGHT

This invention relates to night lights, and, more particularly, to a bubbler and automatic light combination.

It is therefore the principal object of this invention to provide an automatic light, which, when turned on, will go off automatically, thus giving a person time to go to bed, to another room or to another light switch.

Another object of this invention is to provide an automatic light, which may be used as a child's toy.

Other objects of the invention are to provide a bubbler and automatic light combination, which is simple in design, inexpensive to manufacture, rugged in construction, easy to use and efficient in operation.

These and other objects will be readily evident, upon a study of the following specification, and the accompanying drawing, wherein:

FIG. 1 is a side view of the present invention, shown in elevation, and partly broken away;

FIG. 2 is a cross-sectional view taken along the line 2—2 of FIG. 1;

FIG. 3 is a schematic wiring diagram of the invention.

According to this invention, a bubbler and automatic light combination 10, is shown to include a housing 11, of L-shaped configuration. The surfaces 12 are used as base means, for holding housing 11 upright. Fixedly secured to housing 11 is a pair of air lines 13, each having a valve 14, for a purpose which hereinafter will be described.

In the apex portion of housing 11, on its interior, are fixedly secured a pair of inner walls 15, which provides for dual compartments on the interior of housing 11. A hollow tube 16 of arcuate configuration, is fixedly secured within inner walls 15, the ends 17 projecting therefrom, and serving as jet means for the combination 10.

Also on the interior of combination 10, is a diaphragm 18, at each end of the housing 11, the diaphragm 18 being fixedly secured to the inner peripheral surfaces of housing 11. Switch means 19 is operated by each of the diaphragms 18. When one or the other end portions, of housing 11, are elevated, water, within the compartment means, will trickle through a jet end 17 of tube 16, causing a vacuum within the housing 11 to draw air through air line 13. The valve 14 is under the water level, which will cause bubbles to flow through air line 13, in the elevated portion of housing 11, and the lower air line 13 will take air from the compartment portion to valve 14. The length of time for the bubbling to occur will be adjusted by means of the valve 14. As the water level lowers, the diaphragm 18 will close its respective contact points 19, which will close the circuit between the bulb 20 and the batteries 21. The bulbs 20 are covered by means of translucent domes 22, so as to look neat and attractive.

It shall be noted that an on-off switch 23 is secured to the combination 10, so as to open or close the circuit, when desired.

While various changes may be made in the detail construction, it is understood that such changes will be within the spirit and scope of the present invention, as is defined by the appended claims.

What I now claim is:

1. A buffler and automatic light combination, comprising an L-shaped housing, a pair of diaphragms secured in said housing for closing switch means to at least one bulb means, an arcuate tube secured in said housing for bubbling water from one compartment means of said housing to another, air line means secured to said housing, and valve means secured to said air line means, for controlling the length of time said bulb means will stay on.

2. The combination according to claim 1, wherein the leg portions of said housing are triangular in cross-sectional configuration, one surface serving as base resting means for said combination and a bulb is secured in each end of said housing in a spaced apart relationship with said diaphragm means and switch, said diaphragm being fixedly secured to the inner peripheral surfaces of said housing.

3. The combination according to claim 2, wherein said compartment means is defined within each leg portion of said housing by said diaphragm means and inner wall means fixedly secured in the apex portion of said housing, said inner wall means having fixedly secured therein, said arcuate tube, each of the ends of said arcuate tube extending partially from said inner walls so as to form jet means for water to pass from one compartment to the other of said housing, and said air line means is fixedly secured externally of said leg portions of said housing at each end, and one of said ends being provided with control valve means, below the water level and said water travelling through said arcuate tube, causes vacuum means to operate switch means, one of the switch points being secured fixedly to said diaphragm.

4. The combination according to claim 3, wherein the circuit of said combination includes battery means and on-off switch means in combination with said diaphragm operated switch means.

* * * * *